United States Patent [19]

Lohse

[11] Patent Number: 4,875,596

[45] Date of Patent: Oct. 24, 1989

[54] FLEXIBLE VESSEL

[76] Inventor: Jürgen Lohse, Norderstedter Str. 88 A, D-2359 Henstedt-Ulzburg, Fed. Rep. of Germany

[21] Appl. No.: 177,546

[22] PCT Filed: Jul. 22, 1987

[86] PCT No.: PCT/EP87/00400

§ 371 Date: Mar. 22, 1988

§ 102(e) Date: Mar. 22, 1988

[87] PCT Pub. No.: WO88/00913

PCT Pub. Date: Feb. 11, 1988

[30] Foreign Application Priority Data

Jul. 25, 1986 [DE] Fed. Rep. of Germany ..... 3625224

[51] Int. Cl.[4] ..... B65D 88/16

[52] U.S. Cl. ..... 220/403; 105/423; 220/1 B; 220/85 B

[58] Field of Search ..... 105/359, 423; 220/1 B, 220/3, 85 B, 855, 403, 404, 461; 222/105, 183; 383/68, 69, 78, 80, 81

[56] References Cited

U.S. PATENT DOCUMENTS

| | | | |
|---|---|---|---|
| Re. 29,721 | 8/1978 | Ukmar et al. | 220/403 |
| 3,658,205 | 4/1972 | Kasravi | 220/461 |
| 3,756,469 | 9/1973 | Clark et al. | 105/423 |
| 4,124,136 | 11/1978 | Bjelland et al. | 222/105 |
| 4,461,402 | 7/1984 | Fell et al. | 222/105 |
| 4,557,400 | 12/1985 | Clarke | 222/105 |

FOREIGN PATENT DOCUMENTS

| | | | |
|---|---|---|---|
| 0948039 | 5/1974 | Canada | 105/423 |
| 3000082 | 7/1980 | Fed. Rep. of Germany . | |
| 8322697 | 11/1983 | Fed. Rep. of Germany . | |
| 1222889 | 1/1960 | France . | |
| 0925781 | 5/1982 | U.S.S.R. | 220/440 |

OTHER PUBLICATIONS

"Rubber Tanks for Oil Tested in Box Cars", author unknown, Popular Science Magazine, 6-1943.

*Primary Examiner*—Jimmy G. Foster
*Attorney, Agent, or Firm*—Lane & Aitken

[57] ABSTRACT

A flexible vessel (11) for transporting or storing parcels, bulk materials, ammunition, gases or liquids and the same is shaped in the form of a tube, having opens ends tightly sealed by means of straight or line-like clamp connection parts (14). The clamp connection parts are formed toothed rack-like so that, with relatively short clamp connection parts, tubes with relatively large openings can be sealed tightly. The clamp connection parts can be held by means of an extension part (31, 32, 33) in a container (10) or in a frame, spaced above a floor.

21 Claims, 5 Drawing Sheets

FLEXIBLE VESSEL

The invention relates to a flexible vessel of plastic or elastomeric material for the transportation and storage of parcels, preferably vehicles or military equipment, gases, liquids ammunition or bulk material, which is provided with filling and discharge openings.

The invention furthermore relates both to a flexible vessel, which is located in a kind of trough, as well as to a container with vessels provided inside it.

It is, for example, known to transport liquids in a container, and for this purpose the container is provided with a tightly sealable inner vessel which is made of flexible plastic material. In its filled condition this vessel takes up substantially the form of the inner space of the container. In order to prevent the liquid present in the vessel from undesired movements (rolling or sloshing movements) during transportation, nets or straps are attached over the container such that these fix the plastic material vessel upright and against movement.

Due to the size of the common containers (the front surfaces have dimensions in the region of a few meters, whereas the length is about 10 meters), the manufacture of vessels suited for liquids is problematic, although they substantially correspond to the quadratic form of the container. There is also to be added the fact that, during transportation, the plastic material vessel is subjected to considerable load forces due to the movement of the liquid. For instance, a container may be transported on a freight car, which in turn runs off a roll-off slope and runs undampened against a stop block. In this case, such mass forces can result from the liquid that the plastic material vessel and the container may be destroyed.

The invention deals with the problem of improving the manufacture of liquid vessels suitable for containers and, moreover, to plastic material vessels and metal containers which are not subject to destruction by transportation load forces.

This is reached by means of a flexible vessel according to the claims.

The vessel according to the invention is made of a suitable material, that can also be multi-layered, by means of joining strips together to form a tube. This kind of production is technically known. Sufficiently long strips can, for example, be joined together by means of high frequency welding from webs of polar plastic material into a tube.

The two open ends of such a tube are then joined together by means of clamp connection parts fitting together. If a tube is selected which takes up the largest possible part of the inner space of a container, then, in order to close one opening along a straight line, one clamp connection part would be necessary which is longer than the width of the container. Therefore, in one embodiment of the invention, the two clamping parts are provided with clamping jaws, which have an undulated surface. If, for example, tooth rack-like clamping jaws with a tooth angle of 60° are used, then, by means of the back-and-forth placing of the edge of the tube onto the undulated surface of the clamping jaws a clamping bar can be used, which only has a length of about a quarter of the circumference of the tube. In a suitable embodiment in accordance with the invention, such a length is selected so that the clamp connection parts fit exactly at both ends into the door opening of the container or are somewhat smaller. After the tubular vessel has been closed in this manner on both sides, the clamp connection parts are attached in the frame of the door opening of the container by means of expanding parts or the like at a particular height above the floor surface of the container. This attachment above the floor surface of the container leads to the fact that, on the one hand, the filled container always has a shape predetermined by the pretension of the vessel so that the oscillations during transportation can be counteracted and no destruction of the vessel occurs. To this, it is to be added that, by means of suitable attachment, the lower half of the tubular vessel is in a tensioned condition as well so that a complete emptying of the tubular vessel is possible.

The tubular vessel according to the invention doesn't have to be formed of two equal upper and lower halves. An "asymetric" embodiment, rather, is more advantageous, since by forming the lower part in the shape of a tub and by forming the upper part in the shape of a tensioned membrane, a vessel is constituted, which, after being filled with the liquid to be transported, is hardly subjected to oscillation stress during transportation.

The vessel according to the invention does not necessarily have to consist of a single tubular casing. It can rather be a multi-casing embodiment so that dangerous goods can be transported or stored by means of a flexible vessel according to the invention. In this case, a relatively thick-walled outer casing mainly takes up the mechanical stresses, whereas a relatively thin inner casing, for example, in the form of a bubble, serves to surround particularly aggressive or dangerous media tightly. The bubble, can be produced by blow moulding from a material suitable for the transport of the particular dangerous liquid. This inner bubble need only have a low mechanical strength since the outer casing provides the vessel as a whole with the strength required for receiving and transporting the liquid. Thus, a material can be used for the outer casing, which, above all, has the required mechanical properties, so that the aggressiveness of the medium that is to be transported does not have to be considered. When the outside of a flexible vessel according to the invention has been damaged, this vessel can be used again, if a closed bubble is introduced into the inner space.

It is furthermore possible to provide the tubular vessel with a base support on joining the edge openings. This base support is placed, together with the two put together halves of the opening, between the clamping jaws and is attached there. In this way, the vessel can reach a still greater mechanical stress capacity or strength. A particularly stressed part of the tubular vessel can be protected, as against the floor, especially when the vessel according to the invention is placed in a trough in the soil.

The invention will, in the following be described with the drawing as an example.

In the figures the outlines of a container 10 are shown by means of dash-and-dotted lines. In the container 10 there is a tubular flexible vessel 11, which takes up a flattened shape on its sides caused by the side surfaces of the container. However, vessel 11 otherwise has substantially a cylindrical tubular form. The term "container" is intended to include structures which are open, such as frames within which the flexible vessel 11 is positioned, as well as containers having enclosing surfaces. Of course, where the container does not have side surfaces, the flexible vessel 11 will not have the same flattened shape on its sides.

The two openings of the tube opposite to each other are tightly closed by means of straight line clamp connection parts 14.

Figure 1:
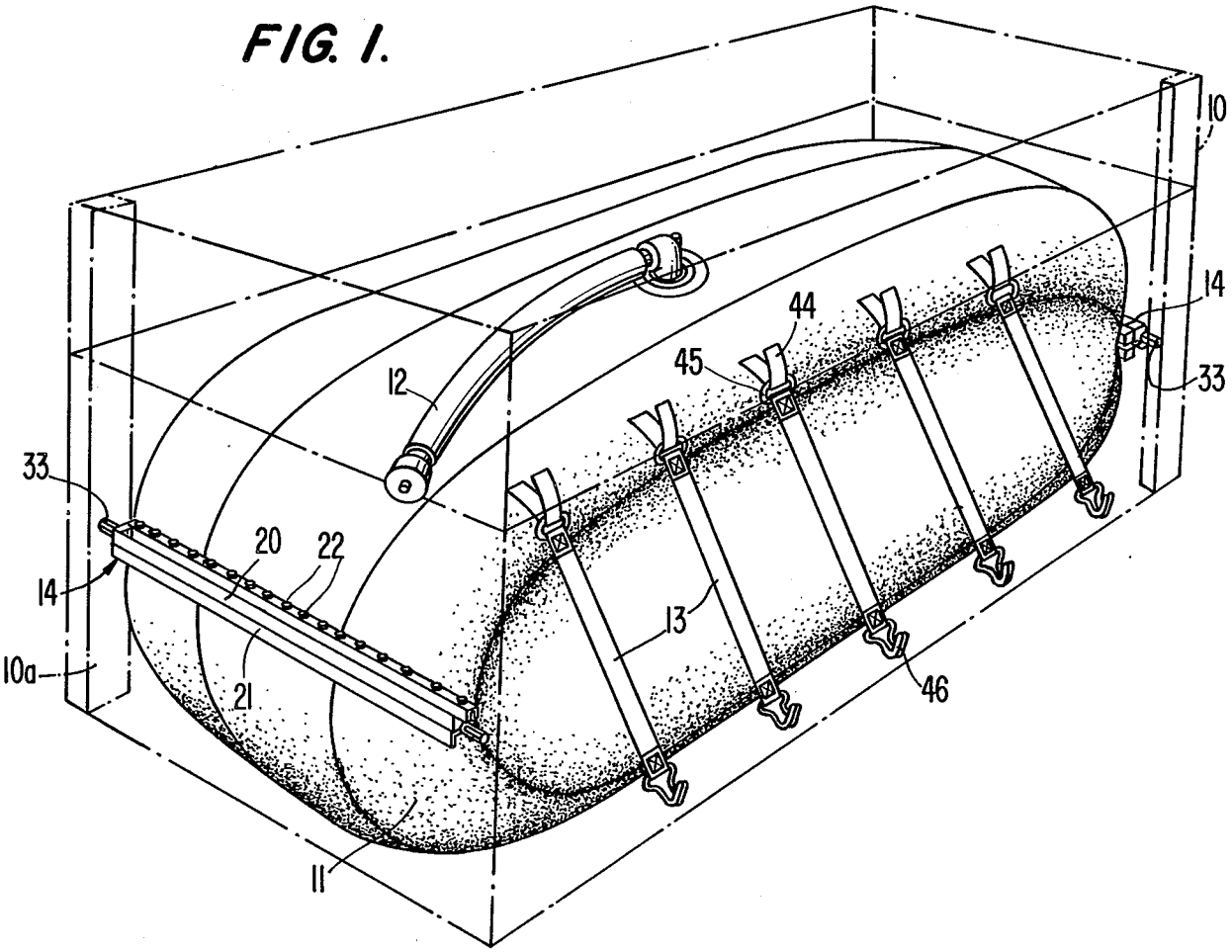
FIG. 1 shows a perspective view of a flexible vessel in a transportation container made of metal.

In FIG. 1 at the top, a filling means in the form of a tube or an opening 12 is shown.

To the tubular vessel 11 several attachment parts, namely straps 13, are applied along the length of the vessel, the straps being secured by means of their free ends in the lower region of the container 10.

Figure 2:
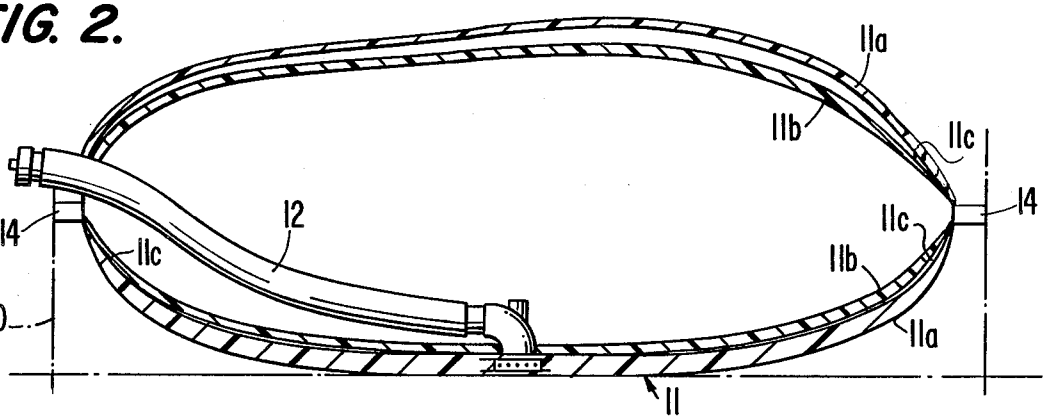
FIGS. 2 and 3 show longitudinal cross-sectional views of a non-filled flexible vessel.
Figure 3:
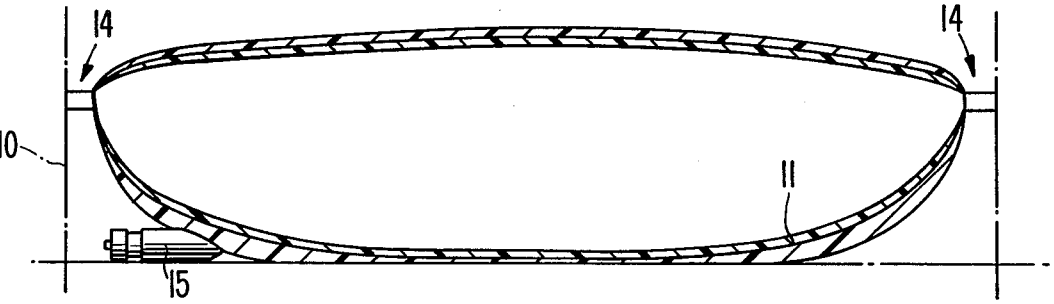

FIGS. 2 and 3 show the vessel 11 in the container 10 in the empty condition. In the embodiment according to FIG. 2, the charging and discharge arrangement 12 is located aloft whereas in FIG. 3 a short discharge pipe 15 is located at the bottom.

In FIGS. 1 to 3 it can be seen that the attachment parts 14 are attached at a particular height above the floor surface of the container 10 at the opening frame of the container 10. Thus, it can be seen that, even when the vessel 11 is being filled with liquid, the vessel 11 hereby assumes a form which is favourable regarding the occurring oscillatory stresses.

Figure 4:
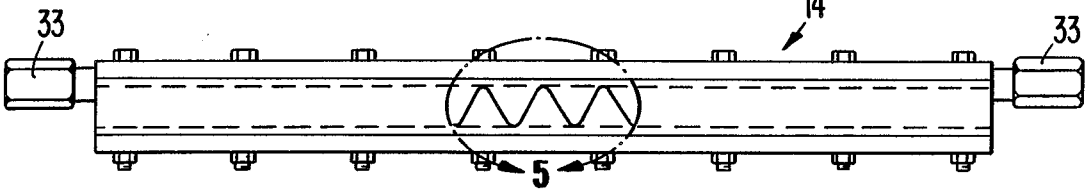
FIG. 4 is a longitudinal view of a clamping part.
Figure 5:
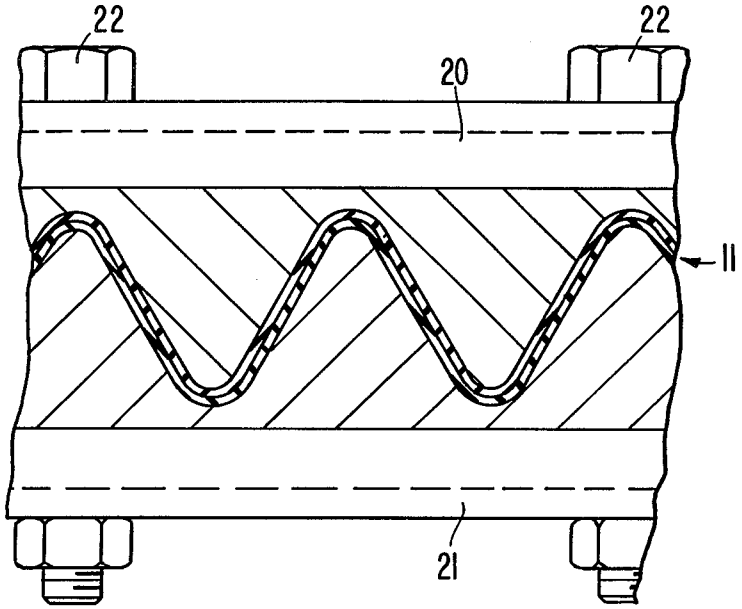
FIG. 5 is an enlargement of a portion of the clamping part of FIG. 4.

In FIGS. 4 and 5 a clamp connection part 14 is shown. It consists of two longitudinal clamping jaws 20 and 21, which fit together. However, the two cooperating surfaces of the clamping jaws 20 and 21 are not flat but have undulating surfaces fitting together. The two clamping jaws 20 and 21 receive the upper and lower edge parts of a tubular vessel 12, as can be seen in FIG. 5. If the screwed connections, indicated by 22, are tightened, the two opposing inner surfaces of the tubular lining 11 are pressed together to be gas and liquid tight.

Figure 6:
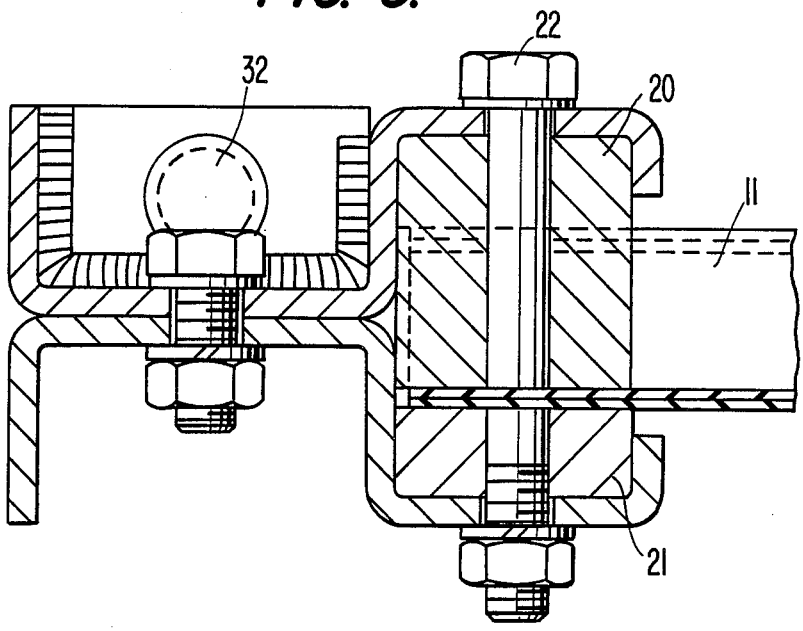
FIG. 6 shows a cross-sectional view of the clamping part according to FIG. 5 (on an enlarged scale as compared to FIG. 4).

FIG. 6 shows the clamping jaws 20 and 21 and the left end of the tubular vessel 11. The righthand end the tubular vessel 11 is to be assumed to exist. From the area shown in FIG. 6, this vessel proceeds into the substantially cylindrical form of FIG. 1. The abutting edges at the left end of the vessel 11 are located in the compressing region between the two clamping jaws 20 and 21. It can be appreciated that instead of the two edges shown in FIG. 6 of a single tubular vessel 11, several vessels or casings **11*a* and 11*b* arranged within each other can be clamped between the clamping jaws 20 and 21 in the same manner, as is shown in FIG. 2**.

The vessels **11*a* and 11*b* can be secured to one another by gluing or welding, as is indicated generally at 11c. The two vessels 11*a* and 11*b* are engaged by the same clamping connecting parts 14 and are closed thereby. The inner casing or vessel 11*b* can be a bubble produced by bubble blow molding. The outer casing or vessel 11*a* has a thickness of 1 millimeter, up to a few millimeters, whereas the inner casing 11*b* has a thickness of less than 1 millimeter. The inner casing 11*b* can be made of, for example, a polyethylene foil or a polytetrafluoroethylene foil. An asymmetric embodiment of the invention is illustrated in FIG. 3 wherein a lower part 11*d* has the shape of a tub and an upper part 11*e* has the shape of a tensioned membrane, the upper part 11*e* defining a smaller portion of the height of the vessel 11 than the lower part 11*d* does. Each of the upper and lower parts is can be made of a single layer of material or, as illustrated in FIG. 3**, multiple layers of material.

Figure 7:
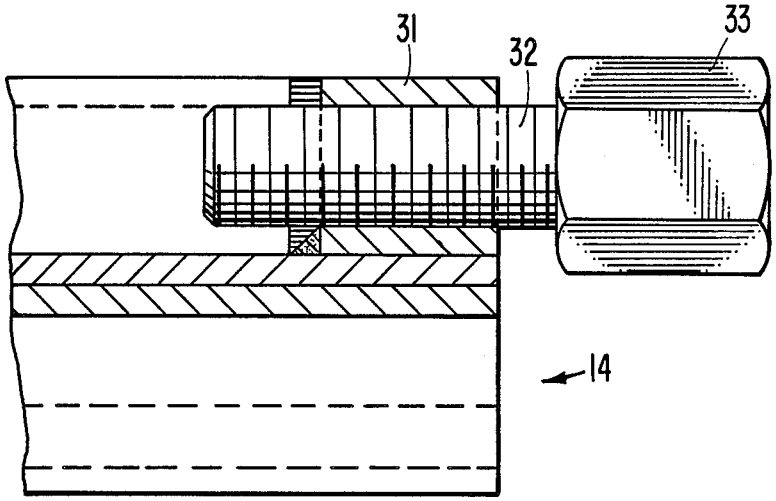
FIG. 7 shows the end portion of a clamping part with the tension device.

In FIG. 4, but also in FIGS. 6 and 7 extension parts 33 can be seen. Each extension part 33 includes a bolt-type part 32, which in its outer region has a hexagonal head. The threaded part of the bolt 32 is screwed into a complementary threaded piece 31. Parts 31 are attached at the two ends of a clamping part 14. It particularly clear from FIGS. 4 and 7 that, by rotating the bolt 32, the axial total length of the clamp connection part 14 can be increased or reduced. After the sealing of the openings of the tubular vessel 11 by pressing together the two clamping jaws 20 and 21, both clamping parts 14 are placed into the door post openings of the container 10, and the bolts 32 are turned out far enough that a strong holding of the clamping parts 14 is achieved in the door frame of the container 10 (shown in FIGS. 1 to 3).

Figure 8:
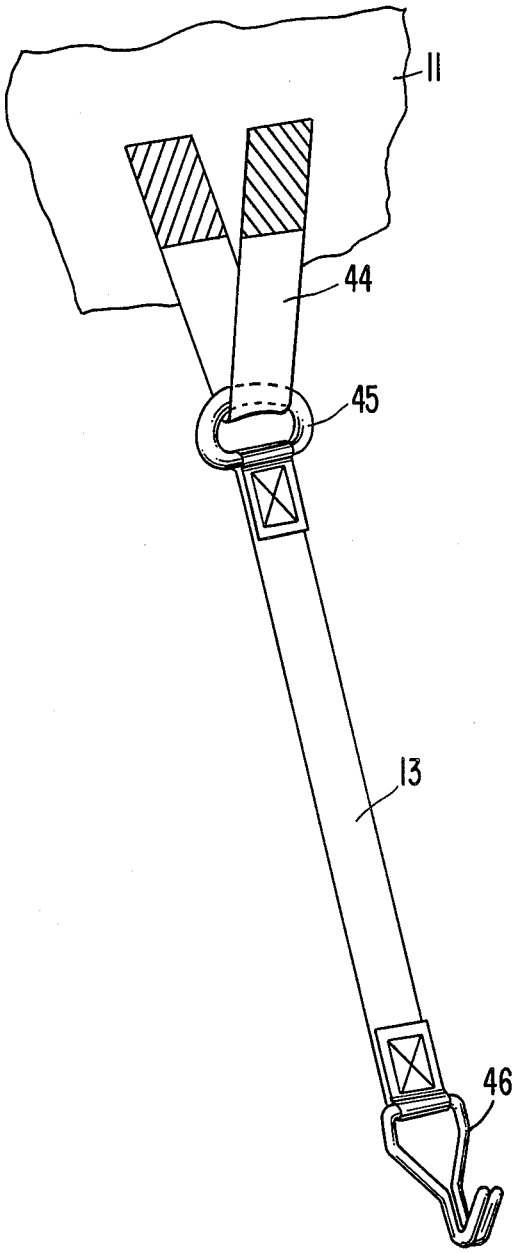
FIG. 8 shows a perspective view of a strap attached to the vessel.

FIG. 8 shows how the straps 13 have been attached to the tubular vessel 11. A plastic material part 44 is welded to the vessel 11 as a loop, in which an eye or D-ring 45 is hanging. The strap 13, which has a hook 46 at its lower end, is attached to the eye 45. The straps 13 can be longitudinally adjustable. They are fixed on the lower region of the container 10 in a way so that the tubular vessel 11 is fixed in view of possible transportation oscillations of the contained liquid.

As materials for the tubular vessel, plastic materials or elastomers are applicable, these materials surrounding one or more fabric layers from both sides and penetrating them. For example, elastomers (nitrile rubber, butyl rubber or the like) can be used but also thermoplastics (PVC, PP, PE). If materials having a polar character are used, the individual webs can be welded together by high frequency.

Instead of the profile of the clamping jaws shown in FIGS. 4 and 5, other labyrinth-type sealing arrangements can be used. It is essential in this connection to house a tubular vessel 11 that is as large as possible inside a container 10, whereby the straight line clamping connection parts must not be larger than the transverse dimension of the door opening of the container.

I claim:

1. Apparatus for holding goods comprising:

a flexible vessel comprising a tube having two tube ends and adapted to receive the goods, the vessel having at least one opening for filling and discharging the goods, the vessel being made of one of an elastomeric material and a thermoplastic material; and a clamp attached to each of said tube ends, each clamp defining a length, at least one of the clamps having an extension part movable with respect to the rest of the clamp to extend the length of the clamp, said clamp having the extension part being adapted for attachment under compression between parts of a container.

2. The apparatus according to claim 1, wherein the extension part comprises means for attaching the clamp to the container by a force which places the clamp under compression.

3. The apparatus according to claim 1, wherein the container has an end, an opening at said end, and said clamp is attached to said container at said opening by said extension part.

4. The apparatus according to claim 1, wherein the flexible vessel has a horizontal longitudinal plane of symmetry, and the clamps are attached to the tube ends substantially in said plane of symmetry.

5. The apparatus according to claim 1, wherein the tube is asymmetrical, defines a height, and comprises an upper part superimposed over a lower part, the upper part defining a smaller portion of the height of the tube than the lower part does.

6. The apparatus according to claim 1, wherein the tube comprises at least two discrete casings, one within another, and said clamps clamp all of said casings.

7. The apparatus according to claim 6, wherein the casings are joined to one another.

8. The apparatus according to claim 6, wherein an inner casing is a bubble blow molded bubble.

9. The apparatus according to claim 6, wherein an outer casing has a thickness of at least one millimeter, and an inner casing has a thickness of less than one millimeter.

10. The apparatus according to claim 9, wherein said inner casing is made of a polyethylene foil.

11. The apparatus according to claim 9, wherein said inner casing is made of a polytetrafluoroethylene foil.

12. The apparatus according to claim 1, wherein the tube comprises at least two layers.

13. The apparatus according to claim 1, further comprising means for holding down said flexible vessel within said container.

14. The apparatus according to claim 13, wherein said holding down means comprises straps attached at one end to said flexible vessel.

15. The apparatus according to claim 14, wherein loops are secured to said flexible vessel, said one end of said straps are attached to said loops, and hooks are secured to an opposite end of said straps to secure the straps to a supporting surface.

16. The apparatus according to claim 1, wherein said extension part comprises a bolt having threads engaging mating threads at an end of said clamp.

17. The apparatus according to claim 1, wherein said clamp has a said extension part at each end of said clamp.

18. The apparatus according to claim 1, wherein each said clamp has an extension part.

19. The apparatus according to claim 18, further comprising a container, said clamps attaching said tube to said container.

20. The apparatus according to claim 1, wherein at least one end of said tube comprises unattached edges of material, one of said clamps holding said edges in sealing engagement with one another.

21. The apparatus according to claim 20, wherein both ends of said tube comprise unattached edges of material, and said clamps hold said edges at said end of said tube in sealing engagement with one another.

* * * * *